United States Patent [19]

Stephens

[11] 3,990,178

[45] Nov. 9, 1976

[54] DANCING DOLL

[75] Inventor: Herman A. Stephens, San Francisco, Calif.

[73] Assignee: Lawrence Peska Associates, Inc., New York, N.Y. ; a part interest

[22] Filed: Apr. 10, 1975

[21] Appl. No.: 566,946

[52] U.S. Cl. ..... 46/228; 46/267; 46/121; 46/137

[51] Int. Cl.[2] ..... A63H 13/00

[58] Field of Search..... 46/228, 245, 121, 136–138

[56] References Cited

UNITED STATES PATENTS

| | | | |
|---|---|---|---|
| 845,985 | 3/1907 | Thornton | 46/137 |
| 1,205,151 | 11/1916 | Bruce | 46/137 |
| 1,590,563 | 6/1926 | Childs | 46/137 |
| 2,137,575 | 11/1938 | Lincoln | 46/137 |
| 2,334,212 | 11/1943 | Monkres | 46/245 |
| 2,647,222 | 7/1953 | Nieset | 46/228 |
| 2,725,671 | 12/1955 | Morsch | 46/137 |

*Primary Examiner*—Louis G. Mancene
*Assistant Examiner*—Robert F. Cutting

[57] ABSTRACT

A dancing doll is positioned on a thin platform, wherein the platform is vibrated by means of an electromechanical vibrator communicating with the bottom surface of the platform. The dancing doll consists of a body portion, a head portion joined to the body portion by a spring assembly, loosely jointed arms and legs communicating with the body portion, and feet member communicating the legs. A elongated rod is detachably secured into a center of the back of the body portion. A control switch handle is affixed to the free end of the elongated rod. The user holds the elongated rod in a horizontal, wherein the feet of the dancing doll engages the platform. The rate of vibration of the platform is controlled by a rheostatic unit contained within the control switch handle. The vibrator of the platform causes the legs and arms of the dancing doll to swing in an erratic way, wherein the doll performs a dance on the vibrating platform.

3 Claims, 4 Drawing Figures

DANCING DOLL

SUMMARY OF THE INVENTION

My invention relates to a doll capable of performing a dance on a vibrating platform, wherein the rate of vibration of platform can be controlled by an electromechanical vibrator unit communicating with the bottom surface of the vibrating platform.

A plurality of U.S. Pat. Nos: 845,985; 1,205,151; 1,590,563; and 2,137,575 have employed dancing dolls on a vibrating platform, but the rate of vibration of the platform cannot be effectively controlled in these aforementioned patents.

Accordingly, it is an object of my present invention to provide a means for effectively controlling the rate of vibration of a platform on which a doll performs a dance.

A still further object is to provide a means of effectively varying the rate of vibration of the platform.

Another object of my present invention is to provide a pair of blinking lights for the eyes of the doll.

Briefly, my present invention consists of a body portion, a head portion joined to the body portion by a spring assembly, loosely jointed arms and legs communicating with the body portion, and feet member communicating the legs. A elongated rod is detachably secured into a center of the back of the body portion. A control switch handle is affixed to the free end of the elongated rod. The user holds the elongated rod in a horizontal, wherein the feet of the dancing doll engages the platform. The rate of vibration of the platform is controlled by a rheostatic unit contained within the control switch handle. The vibration of the platform causes the legs and arms of the dancing doll to swing in an erratic way, wherein the doll performs a dance on the vibrating platform.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figures 1, 2, 3, 4:
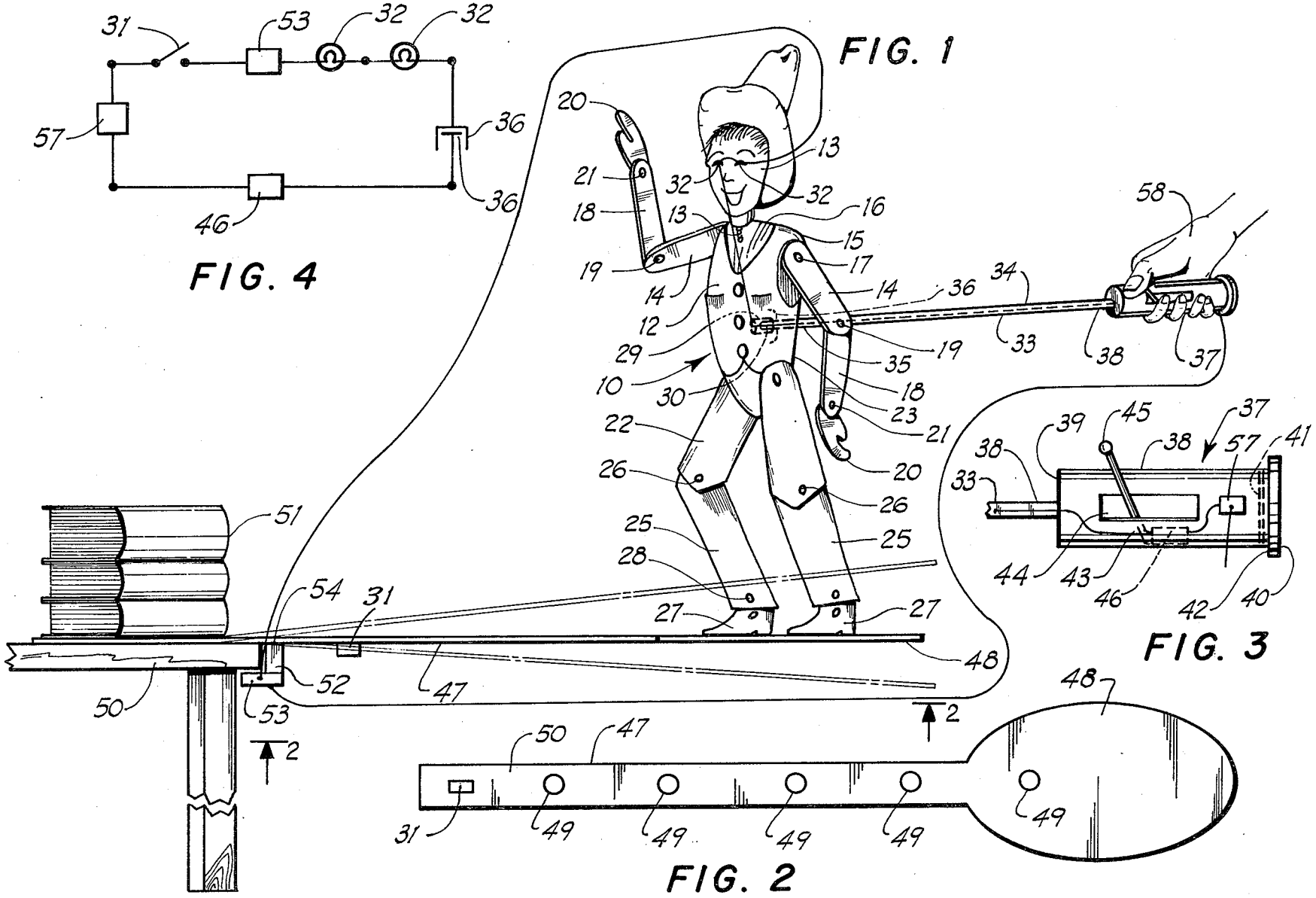
FIG. 1 illustrates a side perspective view of a dancing doll on a controlled vibrating board.
FIG. 2 illustrates a bottom view of the vibrating board taken along line 2—2 of FIG. 1.
FIG. 3 illustrates a cross sectional view of a control switch handle affixed to a control rod.
FIG. 4 illustrates a schematic diagram of the electric circuit of the dancing doll toy.

Turning now descriptively to the drawings, in which similar reference characters denote similar elements throughout the several views, FIG. 1 shows a dancing doll 10 positioned on top of a vibrating platform 11. The dancing doll 10 consist of a body portion 12 of any desired configuration, wherein a head portion 13 is secured to the top base 16 of the body portion 12 by a flexible coil spring assembly 13. An upper arm portion 14 is joined to each side 15 of the body portion 12 by a first link 17. A lower arm portion 18 is joined to a lower free of each upper arm portion 14 by a second link 19. A hand portion 20 is joined to a lower free end of each lower arm portion 18 by a third link 21. An upper leg portion 22 is secured to the side of each hip portion 23 of the body portion 12 by a pin 24. A lower leg portion 25 is secured to a lower end of each upper leg portion 22 by a fourth link 26. A foot member 27 is secured to the lower end of each lower leg portion 25 by a fifth link 28. The back of the body portion has a central aperture 29 therein, wherein a conductive metallic sleeve 30 which is internally threaded is embedded therein. The eyes of the head portion 13 are formed from two blinking light bulbs and socket assemblies 32, wherein assemblies 32 are wired to sleeve 30 by wires contained internally within the body 12 and head 13 portions of the dancing doll 10. An elongated rod 33 of non-conductive material has a continuous passageway 34 therethrough wherein a first end 35 of rod 33 is externally threaded to engage sleeve 30. A conductive metallic disc 36 is affixed to the first end 35 of rod 33, wherein disc 36 conductively engages sleeve 30. A control switch handle 37 is secured to a second end 38 of rod 33.

FIG. 3 shows the control switch handle 37 consisting of a cylindrical housing 38 having a first closed end 39 affixed to the second end 38 of rod 33. A screw cap 40 threadly engages the threaded outer surface 41 of the second open end 42 of housing 38. The sidewall 43 of the housing 38 has a longitudinal slot aperture 44 therethrough, wherein a control bar handle 45 extends outward through aperture 44. The control bar handle 45 communicates with a rheostatic unit 46 contained within housing 38.

The vibrating platform 11 as shown in FIG. 2 consists of a thin rectangular shaped board 47 having a first circular outer end 48. A plurality of clip retaining members 49 are longitudinally aligned along the bottom surface 50 of the platform 11 as well as an on-off switch 31.

Referring back to FIG. 1, the second end 54 of the platform 11 is secured to a table 50 or other stationary object by an appropriate clamp (not shown) or even by a stack of books 51. A vibrating unit 52 powered by a small electrical motor 53 secured to the table 50, wherein the vibrating unit 52 mechanically communicates with the bottom surface 50 of the second end 54 of platform 11.

FIG. 4 shows the electrical circuit 55 of the dancing doll toy 56 consisting essentially of a series circuit of a power supply 57, the on-off switch 31, the electric motor 53, the light bulb and socket assemblies 32, the sleeve 30, the disc 36, and the rheostatic unit 46.

In use, the control switch handle 37 is held in the user's hand 58 and each foot member 27 engages the vibrating platform 11. The vibrations of the platform 11 causes the doll 10 to simulate a dance.

Hence, obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the U.S. is:

1. A dancing doll toy, which comprises:

a. a doll having a body portion, jointed legs and jointed arms rotatably mounted to said body portion, a head portion having a pair of eyes joined to said body portion with a spring assembly, and foot members rotatably communicating with said jointed legs, a back of said body portion having a central aperture therein;

b. a pair of light sockets with bulbs embedded in said head as eyes;

c. a conductive metallic sleeve having an internally threaded surface embedded in said central aperture, said sleeve wired to said pair of light sockets;

d. an elongated rod of non-conductive material having a continuous passageway therethrough, a first end of said rod having a threaded outer surface, said first end of said rod threadably engaging into said sleeve;

e. a control switch handle affixed to said second end of said rod;

f. a conductive circular plate affixed to said first end of said rod, said plate making electrical conduct with said sleeve;

g. a rheostatic unit disposed in said handle, said rheostatic unit wired to said sleeve through the rod;

g. a power supply disposed in said handle, said power supply wired to said rheostatic unit;

i. a platform;

j. means for detachably joining said platform to a stationary object, said platform receiving said foot members of said doll thereon;

k. an on/off switch mounted on said platform;

l. an electric motor removably mounted on said stationary object, said electric motor wired to said on/off switch and said light socket; and m. a vibratory unit mechanically communicating with said platform and said electric motor.

2. A dancing doll toy as recited in claim 1, wherein said control switch handle further comprises:

a. a cylindrical housing having a first closed end and a second open end;

b. a screw cap member engaging a threaded outer surface of said second open end of said housing;

c. said closed end secured to said second end of said rod; and d. a sidewall of said housing having a longitudinal slot aperture therethrough.

3. A device according to claim 2, further comprising a bar handle affixed to said rheostatic unit, said bar handle extending through said housing of said control switch handle.

* * * * *